US005431616A

United States Patent [19]

Centofante

[11] Patent Number: 5,431,616

[45] Date of Patent: Jul. 11, 1995

[54] ARM WRESTLING APPARATUS

[76] Inventor: Umberto G. Centofante, 199 Wollaston Ave., Arlington, Mass. 02174

[21] Appl. No.: 296,035

[22] Filed: Aug. 25, 1994

[51] Int. Cl.[6] ..... A63B 21/04

[52] U.S. Cl. ..... 482/123; 482/905; 482/909

[58] Field of Search ..... 482/905, 123, 129, 909, 482/904; 273/452

[56] References Cited

U.S. PATENT DOCUMENTS

| | | | |
|---|---|---|---|
| D. 264,236 | 5/1982 | Vyhlidal . | |
| 3,662,602 | 5/1972 | Weiss | 482/905 |
| 4,063,727 | 12/1977 | Hall | 482/123 |
| 4,176,837 | 12/1979 | Jeffrey et al. | 482/905 |
| 4,209,167 | 6/1980 | Jansen | 482/123 |
| 4,463,949 | 8/1984 | McCoy, Sr. et al. . | |
| 4,482,149 | 11/1984 | Weldon | 482/123 |
| 4,557,481 | 12/1985 | McClure . | |
| 4,603,857 | 8/1986 | Chipman et al. | 482/905 |
| 4,805,900 | 2/1989 | Sapp . | |
| 4,846,468 | 7/1989 | McCoy, Sr. et al. . | |

*Primary Examiner*—Richard J. Apley
*Assistant Examiner*—Lynne A. Reichard

[57] ABSTRACT

A new and improved arm wrestling apparatus includes a table assembly and a simulated arm assembly supported by the table assembly. The simulated arm assembly includes a plurality of receiver assemblies for receiving respective incremental counterforce resistance elements. The receiver assemblies are arrayed longitudinally beside and symmetrically astride a longitudinal axis. An arm motion limit assembly is supported by the table assembly for limiting motion of the simulated arm assembly. A limit signaling assembly is supported by the table assembly for signaling when the simulated arm assembly reaches a limit of arm motion. The limit signaling assembly includes a force-receiving portion adapted to receive force exerted by an incremental counterforce resistance element when the simulated arm assembly reaches the arm motion limit assembly. A plurality of incremental counterforce resistance elements of different lengths are provided and are adapted to be positioned one-at-a-time between the receiver assemblies on the simulated arm assembly and the force-receiving portion of the limit signaling assembly. The incremental counterforce resistance elements provide for a selection of increments in counterforce resistance to be overcome by a person who moves the simulated arm assembly to the arm motion limit assembly. An indicator assembly, responsive to the limit signaling assembly, is provided for indicating when the simulated arm assembly reaches a limit of arm motion. A rod-force receiving assembly is located between an end of a selected incremental counterforce resistance element and the limit signaling assembly.

19 Claims, 4 Drawing Sheets

24
48
52
15
50
46
54
19
18
21
21
35
23

ARM WRESTLING APPARATUS

BACKGROUND OF THE INVENTION

1. Field of the Invention

The present invention relates generally to exercising apparatus and, more particularly, to an exercising apparatus especially adapted for simulating an opponent in an arm wrestling contest.

2. Description of the Prior Art

The activity of arm wrestling is an activity that is carried out for recreational and competitive purposes. To prepare for an arm wrestling contest a person ideally strengthens the specific muscles that are involved in arm wrestling. To this end, throughout the years, a number of innovations have been developed relating to arm wrestling apparatus, and the following U.S. Pat. Nos. are representative of some of those innovations: 4,463,949; 4,557,481; 4,805,900; 4,846,468; and U.S. Pat. No. Des. 264,236.

More specifically, U.S. Pat. No. 4,463,949 discloses a machine for arm wrestling that is used by two arm wrestling opponents. Through a gearing and lever mechanism, a right-handed contestant can have an arm wrestling contest with a left-handed opponent. This apparatus provides no self-contained counterforce-exerting mechanism so that one person can develop arm wrestling strength by exercising against a counterforce-exerting mechanism.

U.S. Pat. No. 4,557,481 discloses an arm wrestling table which provides seats for two opponents and provides a visual electric indicator apparatus for indicating the winner of the arm wrestling contest. This apparatus provides no self-contained counterforce-exerting mechanism so that one person can develop arm wrestling strength by exercising against a counterforce-exerting mechanism.

U.S. Pat. No. 4,805,900 discloses a strength training amusement device for simulating arm wrestling. The device employs a hydraulic jack for exerting a simulated arm wrestling force. An alarm system is provided to indicate when a user wins against or loses against the device. A distinct disadvantage of using a hydraulic jack for the exertion of a simulated arm wrestling force is the risk of leaks of hydraulic fluid which may be messy and toxic. In this respect, it would be desirable if a simulated arm wrestling device were provided which does not include hydraulic fluid.

U.S. Pat. No. 4,846,468 discloses a team arm wrestling machine which includes a complex of levers and handles that permits a plurality of players on one team to oppose a plurality of opponents on another team. This machine provides no self-contained counterforce-exerting mechanism so that one person can develop arm wrestling strength by exercising against a counterforce-exerting mechanism.

U.S. Pat. No. Des. 264,236 discloses an arm wrestling exercise table. No provisions are made for indicating to a person any degree of arm wrestling achievement. In addition, there is no disclosure of a mechanism for adjusting a variable counterforce for opposing a user's arm strength.

Still other features would be desirable in an arm wrestling apparatus. For example, when a simulated arm on an arm wrestling apparatus is pushed by a person's arm, the simulated arm reaches a limit. In reaching the limit, the simulated arm impacts some object located at the limit. In impacting the object at the limit, damage may be done to both the object and the simulated arm. In this respect, it would be desirable if a simulated arm wrestling device were provided which includes a resilient bumper located at the limit of simulated arm motion to prevent damage to the simulated arm and the object located at the limit of simulated arm motion.

When a person builds up muscular strength, it may be desirable to build the strength up in a gradual way. More specifically, it would be desirable if a simulated arm wrestling device were provided with devices designed to build up counterforce resistance in an incremental way.

For an arm wrestling apparatus that provides an incremental build up of counterforce resistance, it would be desirable if the incremental increases of counterforce resistance can be installed easily and simply.

When a person puts one's elbow on a table to position one's arm for arm wrestling, it is desirable that the elbow remain localized in a specific area during the arm wrestling. The elbow should not slide on the table top. In this respect, it would be desirable if a simulated arm wrestling device were provided with a device to assure that a person's elbow does not slide on a table top during simulated arm wrestling.

Individuals are generally either right-handed or left-handed. In this respect, it would be desirable if a simulated arm wrestling device were provided that is easily used by either right-handed or left-handed persons.

Thus, while the foregoing body of prior art indicates it to be well known to use arm wrestling devices, the prior art described above does not teach or suggest a arm wrestling apparatus which has the following combination of desirable features: (1) provides a self-contained counterforce-exerting mechanism so that one person can develop arm wrestling strength by exercising against a counterforce-exerting mechanism; (2) does not include hydraulic fluid; (3) includes a resilient bumper located at the limit of simulated arm motion to prevent damage to the simulated arm and the object located at the limit of simulated arm motion; (4) builds up counterforce resistance in an incremental way; (5) provides with a device to assure that a person's elbow does not slide on a table top during simulated arm wrestling; (6) is easily used by either right-handed or left-handed persons; and (7) provides that incremental increases of counterforce resistance can be installed easily and simply. The foregoing desired characteristics are provided by the unique arm wrestling apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved arm wrestling apparatus which includes a table assembly and a simulated arm assembly supported by the table assembly. The simulated arm assembly includes a plurality of receiver assemblies for receiving respective incremental counterforce resistance elements. An arm motion limit assembly is supported by the table assembly for limiting motion of the simulated arm assembly. A limit signaling assembly is supported by the table assembly for signaling when the simulated arm assembly reaches a limit of arm motion. The limit signaling assembly includes a force-receiving portion adapted to receive force exerted by an incremental counterforce resistance element when the simulated arm assembly reaches the arm motion limit assembly. A plurality of incremental counterforce resistance elements are provided and are adapted to be positioned one-at-a-time between the receiver assemblies on the simulated arm assembly and the force-receiving portion of the limit signaling assembly. The incremental counterforce resistance elements provide for a selection of increments in counterforce resistance to be overcome by a person who moves the simulated arm assembly to the arm motion limit assembly. An indicator assembly, responsive to the limit signaling assembly, is provided for indicating when the simulated arm assembly reaches a limit of arm motion.

The table assembly includes four legs, an upper horizontal assembly supported by the legs, and a lower horizontal assembly supported by the upper horizontal assembly. The simulated arm assembly includes a simulated hand portion. A simulated arm portion supports the simulated hand portion, and a simulated-arm-supporting assembly supports the simulated arm portion and connects the simulated arm portion to the table assembly. The simulated-arm-supporting assembly includes a base member connected to the table assembly. A plurality of spring assemblies is connected to the base member and supports the simulated arm portion. The spring assemblies includes a rigid fastener connected to the base member. A spring is connected between the rigid fastener and the simulated arm portion of the simulated arm assembly.

A longitudinal axis extends through the simulated arm assembly from the simulated hand portion through the simulated arm portion. One of the spring assemblies lies along the longitudinal axis between the simulated arm portion and the base member, and the other of the spring assemblies are positioned peripheral to the longitudinal axis between the simulated arm portion and the base member. The receiver assemblies on the simulated arm portion are arrayed longitudinally beside and symmetrically astride the longitudinal axis.

The arm motion limit assembly includes a rigid portion supported by the upper horizontal assembly of the table assembly. A resilient bumper portion is supported by the rigid portion. The incremental counterforce resistance elements include a plurality of rigid rods of different incremental predetermined length from each other.

A strap assembly is connected to the table assembly for securing a user's elbow to the table assembly. The strap assembly includes a strap member attached to the table assembly. A slotted buckle is attached to the strap member, and a catch is attached to the table assembly for receiving the slotted buckle for securing a user's elbow to the table assembly.

A rod-force receiving assembly is supported by the table assembly. The rod-force receiving assembly is located between an end of a selected incremental counterforce resistance element and the force-receiving portion of the limit signaling assembly. Each rod-force receiving assembly includes a housing member supported by the upper horizontal assembly of the table assembly. A spring is located within the housing member. A force-receiving plate is connected to the spring for receiving force from an incremental counterforce resistance element, and a ram rod is connected to the force-receiving plate for transmitting force received from the incremental counterforce resistance element to the force-receiving portion of the limit signaling assembly. Each limit signaling assembly includes a switch assembly adapted to be actuated by the ram rod of the rod-force receiving assembly in response to a selected one of the incremental counterforce resistance elements. The limit signaling assembly is connected to the indicator assembly with a conductor assembly.

A storage assembly is supported by the table assembly for storing a plurality of the incremental counterforce resistance elements. The storage assembly includes a base plate attached to the table assembly. The base plate includes a plurality of wells for receiving the incremental counterforce resistance elements. Respective tethers are connected to respective incremental counterforce resistance elements, and tether-anchor assemblies are connected to the base plate for securing the tethers to the base plate.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved arm wrestling apparatus which has all of the advantages of the prior art and none of the disadvantages.

It is another object of the present invention to provide a new and improved arm wrestling apparatus which may be easily and efficiently manufactured and marketed.

It is a further object of the present invention to provide a new and improved arm wrestling apparatus which is of durable and reliable construction.

An even further object of the present invention is to provide a new and improved arm wrestling apparatus which is susceptible of a low cost of manufacture with regard to both materials and labor, and which accordingly is then susceptible of low prices of sale to the consuming public, thereby making such arm wrestling apparatus available to the buying public.

Still yet a further object of the present invention is to provide a new and improved arm wrestling apparatus which provides a self-contained counterforce-exerting mechanism so that one person can develop arm wrestling strength by exercising against a counterforce-exerting mechanism.

Still another object of the present invention is to provide a new and improved arm wrestling apparatus that does not include hydraulic fluid.

Yet another object of the present invention is to provide a new and improved arm wrestling apparatus which includes a resilient bumper located at the limit of simulated arm motion to prevent damage to the simulated arm and the object located at the limit of simulated arm motion.

Even another object of the present invention is to provide a new and improved arm wrestling apparatus that builds up counterforce resistance in an incremental way.

Still a further object of the present invention is to provide a new and improved arm wrestling apparatus which provides with a device to assure that a person's elbow does not slide on a table top during simulated arm wrestling.

Yet another object of the present invention is to provide a new and improved arm wrestling apparatus that is easily used by either right-handed or left-handed persons.

Still another object of the present invention is to provide a new and improved arm wrestling apparatus which provides that incremental increases of counterforce resistance can be installed easily and simply.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
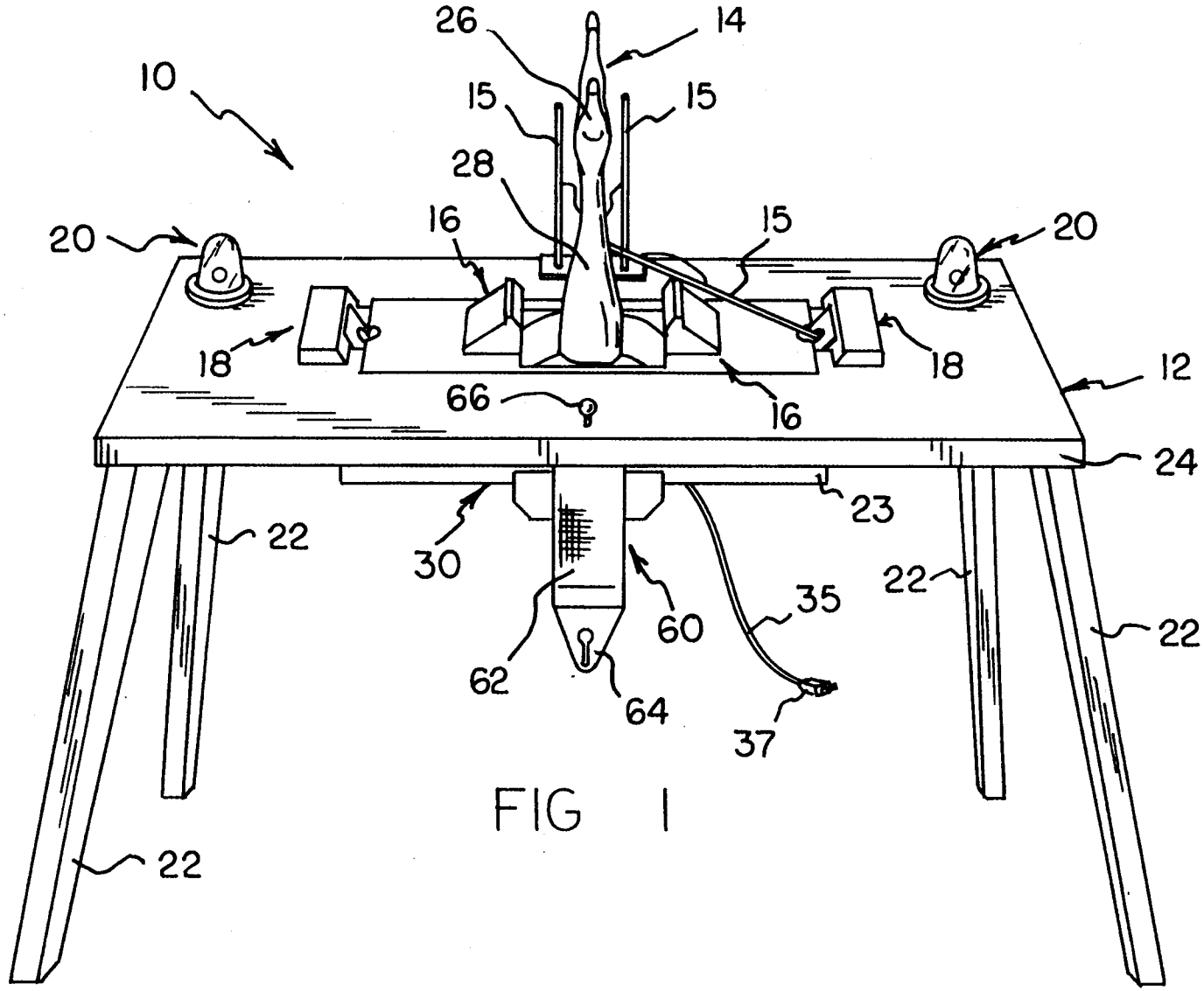
FIG. 1 is a perspective view showing a first preferred embodiment of the arm wrestling apparatus of the invention.

With reference to the drawings, a new and improved arm wrestling apparatus embodying the principles and concepts of the present invention will be described.

Turning initially to FIGS. 1–4, there is shown a first exemplary embodiment of the arm wrestling apparatus of the invention generally designated by reference numeral 10. In its preferred form, arm wrestling apparatus 10 includes a table assembly 12 and a simulated arm assembly 14 supported by the table assembly 12. The simulated arm assembly 14 includes a plurality of receiver assemblies 17 for receiving respective incremental counterforce resistance elements 15. An arm motion limit assembly 16 is supported by the table assembly 12 for limiting motion of the simulated arm assembly 14. A limit signaling assembly 18 is supported by the table assembly 12 for signaling when the simulated arm assembly 14 reaches a limit of arm motion. The limit signaling assembly 18 includes a force-receiving portion 19 adapted to receive force exerted by an incremental counterforce resistance element 15 when the simulated arm assembly 14 reaches the arm motion limit assembly 16. A plurality of incremental counterforce resistance elements 15 are provided and are adapted to be positioned one-at-a-time between the receiver assemblies 17 on the simulated arm assembly 14 and the force-receiving portion 19 of the limit signaling assembly 18. The incremental counterforce resistance elements 15 provide for a selection of increments in counterforce resistance to be overcome by a person who moves the simulated arm assembly 14 to the arm motion limit assembly 16. An indicator assembly 20, responsive to the limit signaling assembly 18, is provided for indicating when the simulated arm assembly 14 reaches a limit of arm motion. Two limit signaling assemblies 18 and two indicator assemblies 20 are provided, one for right-handed persons and the other for left-handed persons.

The table assembly 12 includes four legs 22, an upper horizontal assembly 24 supported by the legs 22, and a lower horizontal assembly 23 supported by the upper horizontal assembly 24. The simulated arm assembly 14 includes a simulated hand portion 26. A simulated arm portion 28 supports the simulated hand portion 26, and a simulated-arm-supporting assembly 30 supports the simulated arm portion 28 and connects the simulated arm portion 28 to the table assembly 12. The simulated-arm-supporting assembly 30 includes a base member 32 connected to the table assembly 12. A plurality of spring assemblies 34 is connected to the base member 32 and supports the simulated arm portion 28. More specifically, the base member 32 of the simulated-arm-supporting assembly 30 is connected to the lower horizontal assembly 23 of the table assembly 12. The spring assemblies 34 includes a rigid fastener 36 connected to respective plates 39 that are attached to the lower horizontal assembly 23 of the table assembly 12. A spring 38 is connected between the rigid fastener 36 and the simulated arm portion 28 of the simulated arm assembly 14.

Figure 2:
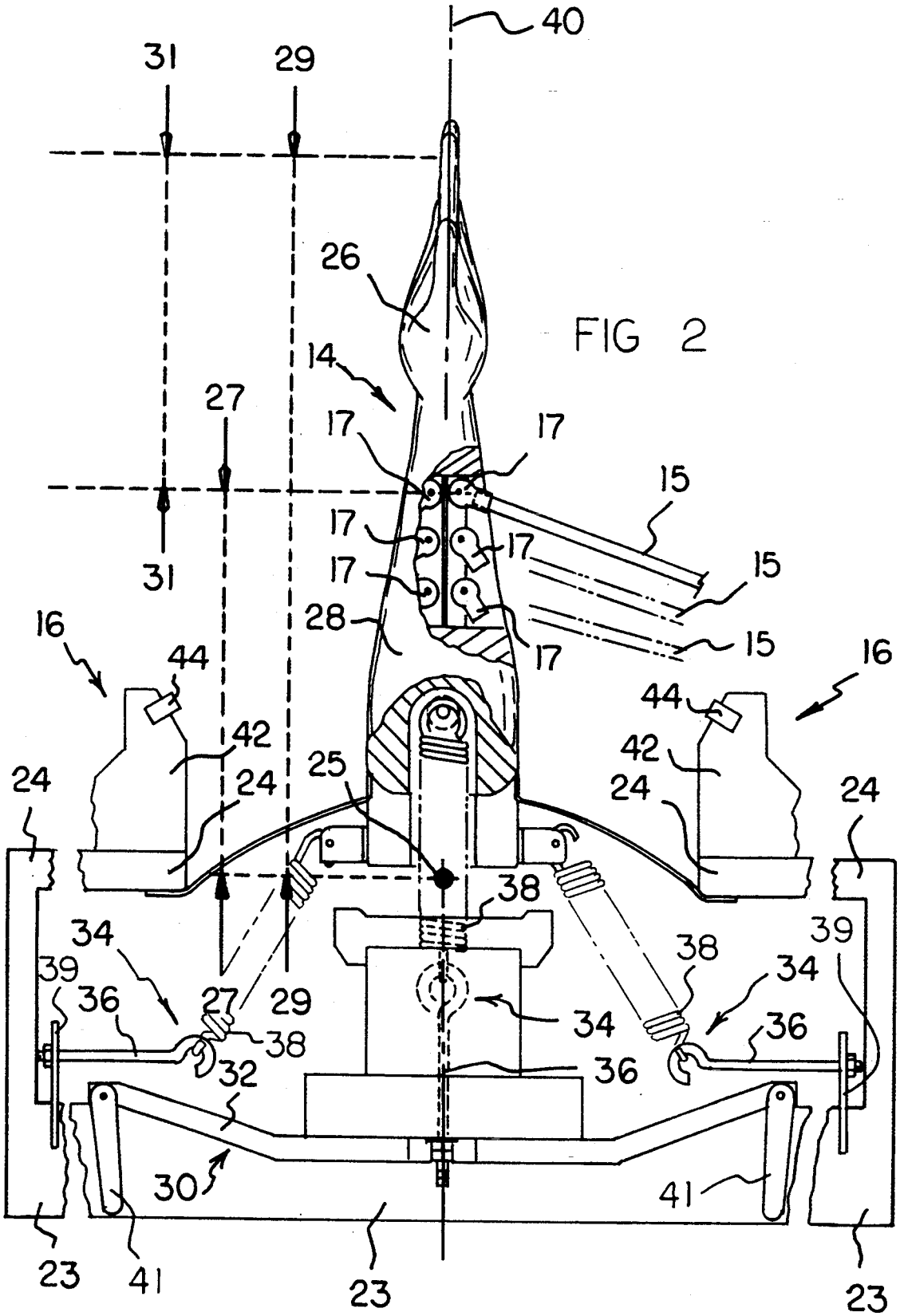
FIG. 2 is an enlarged partial cross-sectional and partially broken away view of the simulated arm assembly shown in the embodiment of the arm wrestling apparatus shown in FIG. 1.

As shown in FIG. 2, retractable legs 41 are connected to the simulated-arm-supporting assembly 30. The retractable legs 41 are hingedly connected to the simulated-arm-supporting assembly 30. When the retractable legs 41 are in the lowered position as shown in FIG. 2, they serve as boundaries in which a person's knees are bounded by. With each person having a common boundary for the person's respective knees, no person will have an advantage over another by spreading one's knees extra widely to obtain added leverage.

A longitudinal axis 40 extends through the simulated arm assembly 14 from the simulated hand portion 26 through the simulated arm portion 28. One of the spring assemblies 34 lies along the longitudinal axis 40 between the simulated arm portion 28 and the base member 32, and the other of the spring assemblies 34 are positioned peripheral to the longitudinal axis 40 between the simulated arm portion 28 and the base member 32. The receiver assemblies 17 on the simulated arm portion 28 are arrayed longitudinally beside and symmetrically astride the longitudinal axis 40. One vertical array of receiver assemblies 17 is used for receiving incremental counterforce resistance elements 15 for modifying counterforce resistance for right-handed persons, and the other vertical array of receiver assemblies 17 is used for left-handed persons.

The arm motion limit assembly 16 includes a rigid portion 42 supported by the upper horizontal assembly 24 of the table assembly 12. A resilient bumper portion 44 is supported by the rigid portion 42. Two arm motion limit assemblies 16 are provided, one for right-handed persons and the other for left-handed persons. The incremental counterforce resistance elements 15 include a plurality of rigid rods 15 of different incremental predetermined length from each other.

A strap assembly 60 is connected to the table assembly 12 for securing a user's elbow to the table assembly 12. The strap assembly 60 includes a strap member 62 attached to the table assembly 12. A slotted buckle 64 is attached to the strap member 62, and a catch 66 is attached to the table assembly 12 for receiving the slotted buckle 64 for securing a user's elbow to the table assembly 12.

Figure 3:
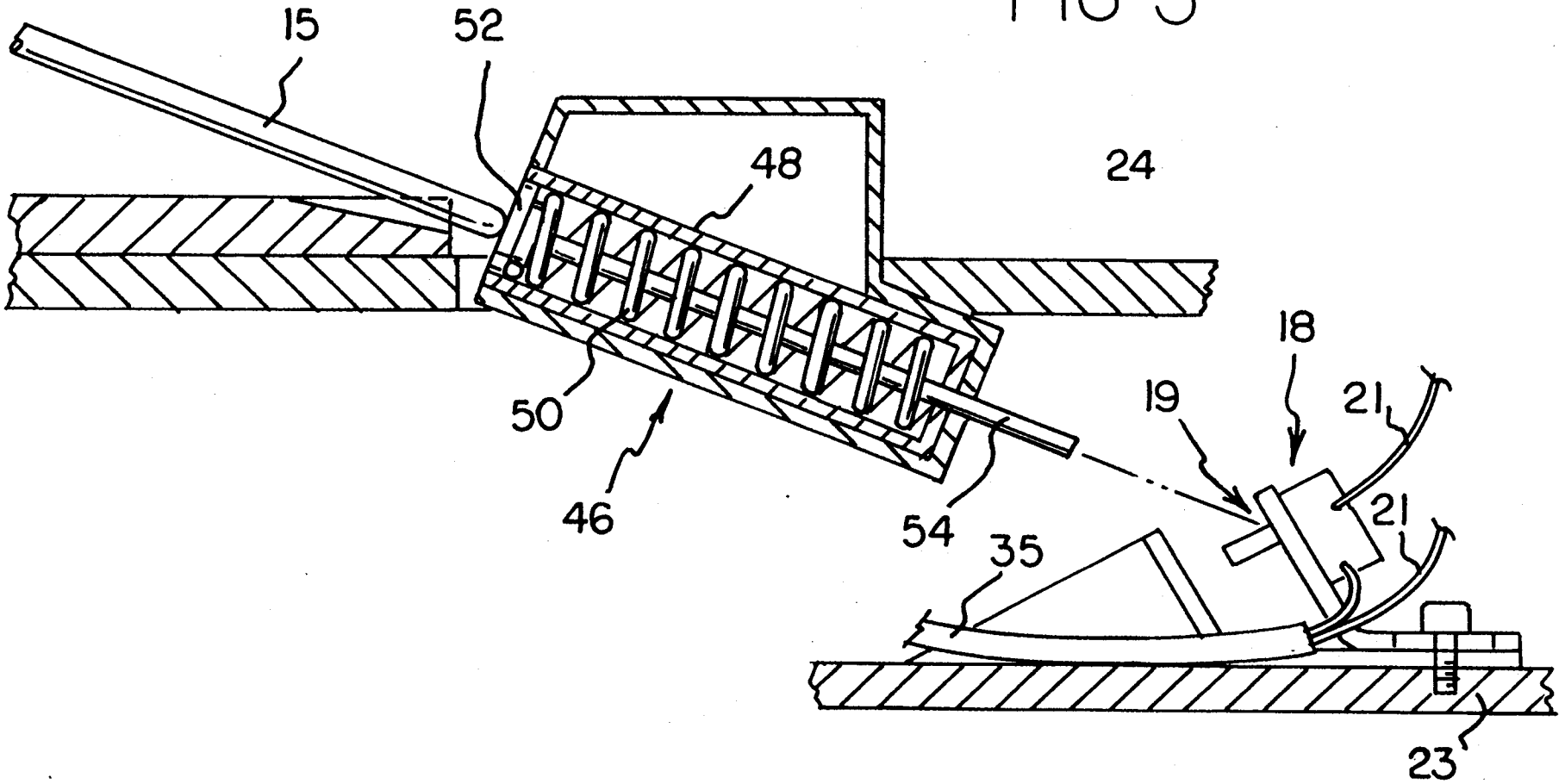
FIG. 3 is an enlarged partial cross-sectional view of a counterforce resistance assembly shown in the embodiment of the invention shown in FIG. 1, also showing a limit switch assembly for indicating when the simulated arm reaches a limit of motion.
Figure 4:
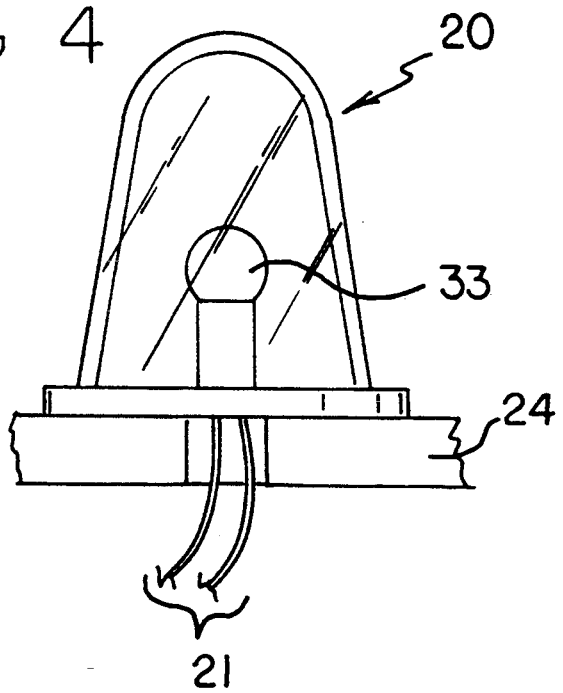
FIG. 4 is an enlarged side view of a signal light assembly used to signal when the simulated arm reaches and activates the limit assembly.

As shown in FIG. 3, rod-force receiving assembly 46 is supported by the table assembly 12. The rod-force receiving assembly 46 is located between an end of a selected incremental counterforce resistance element 15 and the force-receiving portion 19 of the limit signaling assembly 18. Two rod-force receiving assemblies 46 are provided, one for right-handed persons and the other for left-handed persons. Each rod-force receiving assembly 46 includes a housing member 48 supported by the upper horizontal assembly 24 of the table assembly 12. A spring 50 is located within the housing member 48. A force-receiving plate 52 is connected to the spring 50 for receiving force from an incremental counterforce resistance element 15, and a ram rod 54 is connected to the force-receiving plate 52 for transmitting force received from the incremental counterforce resistance element 15 to the force-receiving portion 19 of the limit signaling assembly 18.

The respective lengths of the incremental counterforce resistance elements 15 are provided such that when the simulated arm assembly 14 is moved to the arm motion limit assembly 16, the ram rod 54 of the rod-force receiving assembly 46 is moved to the force-receiving portion 19 of the limit signaling assembly 18. Each limit signaling assembly 18 includes a switch assembly 56 adapted to be actuated by the ram rod 54 of the rod-force receiving assembly 46 in response to a selected one of the incremental counterforce resistance elements 15. The limit signaling assembly 18 is connected to the indicator assembly 20 with a conductor assembly 21. The indicator assembly 20 includes an electric lamp 33 which is powered by AC current flowing through power lines 35 that are connected to an AC source of power through plug 37.

In operation, when the simulated arm portion 28 is tilted toward the right or the left of the arm motion limit assemblies 16, the simulated arm portion 28 rotates around a floating fulcrum 25. A substantially constant portion of counterforce resistance is provided to the motion of the simulated arm portion 28 by the spring assemblies 34. This occurs whether the simulated arm portion 28 is pushed either to the left or the right of the fulcrum 25. A first lever arm 29 exists between the simulated hand portion 26 and the fulcrum 25. A second lever arm 27 exists between a selected receiver assembly 17 and the fulcrum 25. A distance 31 is defined as the difference between the first lever arm 29 and the second lever arm 27.

The spring 50 in the rod-force receiving assembly 46 exerts a counterforce resistance load on the selected receiver assembly 17 when the simulated arm portion 28 is tilted. As shown in FIG. 2, the topmost receiver assembly 17 directs the counterforce resistance from the spring 50 of the rod-force receiving assembly 46 to the second lever arm 27 providing a distance 31 between the first lever arm 29 and the second lever arm 27. However, when an incrementally shorter incremental counterforce resistance element 15 would be selected and fitted into the receiver assembly 17 which is next more proximal to the fulcrum 25, the effective distance 31 is increased, and the effective counterforce resistance exerted by the spring 50 of the rod-force receiving assembly 46 is decreased due to an increase in leverage applied to the newly selected receiver assembly 17. Moreover, when a yet shorter incremental counterforce resistance element 15 would be selected and fitted into the receiver assembly 17 which is still next more proximal to the fulcrum 25, the effective distance 31 is still increased, and the resulting counterforce resistance exerted by the spring 50 of the rod-force receiving assembly 46 is decreased further due to a further increase in leverage applied to the still newly selected receiver assembly 17.

In this way, by using incrementally shorter incremental counterforce resistance elements 15 placed in receiver assemblies 17 that are incrementally more proximal to the fulcrum 25, the effort applied to the simulated hand portion 26 that is required to move the simulated hand portion 26 to a respective arm motion limit assembly 16 is incrementally decreased. Conversely, by using incrementally longer incremental counterforce resistance elements 15 placed in receiver assemblies 17 that are incrementally more distal to the fulcrum 25, the effort applied to the simulated hand portion 26 that is required to move the simulated hand portion 26 to a respective arm motion limit assembly 16 is incrementally increased.

For convenience, the incremental counterforce resistance elements 15 can be supplied in three incremental lengths, short, medium, and long. The force to be applied to the simulated hand portion 26 of the simulated arm portion 28 to move the simulated arm portion 28 to a respective arm motion limit assembly 16 is respectively greatest, medium, and least for the respective long, medium, and short length incremental counterforce resistance elements 15.

It is noted that the counterforce resistance supplied to the simulated arm portion 28 comes from two sources, the spring assemblies 34 and the rod-force receiving assembly 46. The portion of the counterforce resistance that is provided by the spring assemblies 34 is substantially constant. The portion of the counterforce resistance that is provided by the rod-force receiving assembly 46 is variable and depends upon the specific length of a specific incremental counterforce resistance element 15 that is employed.

Figure 5:
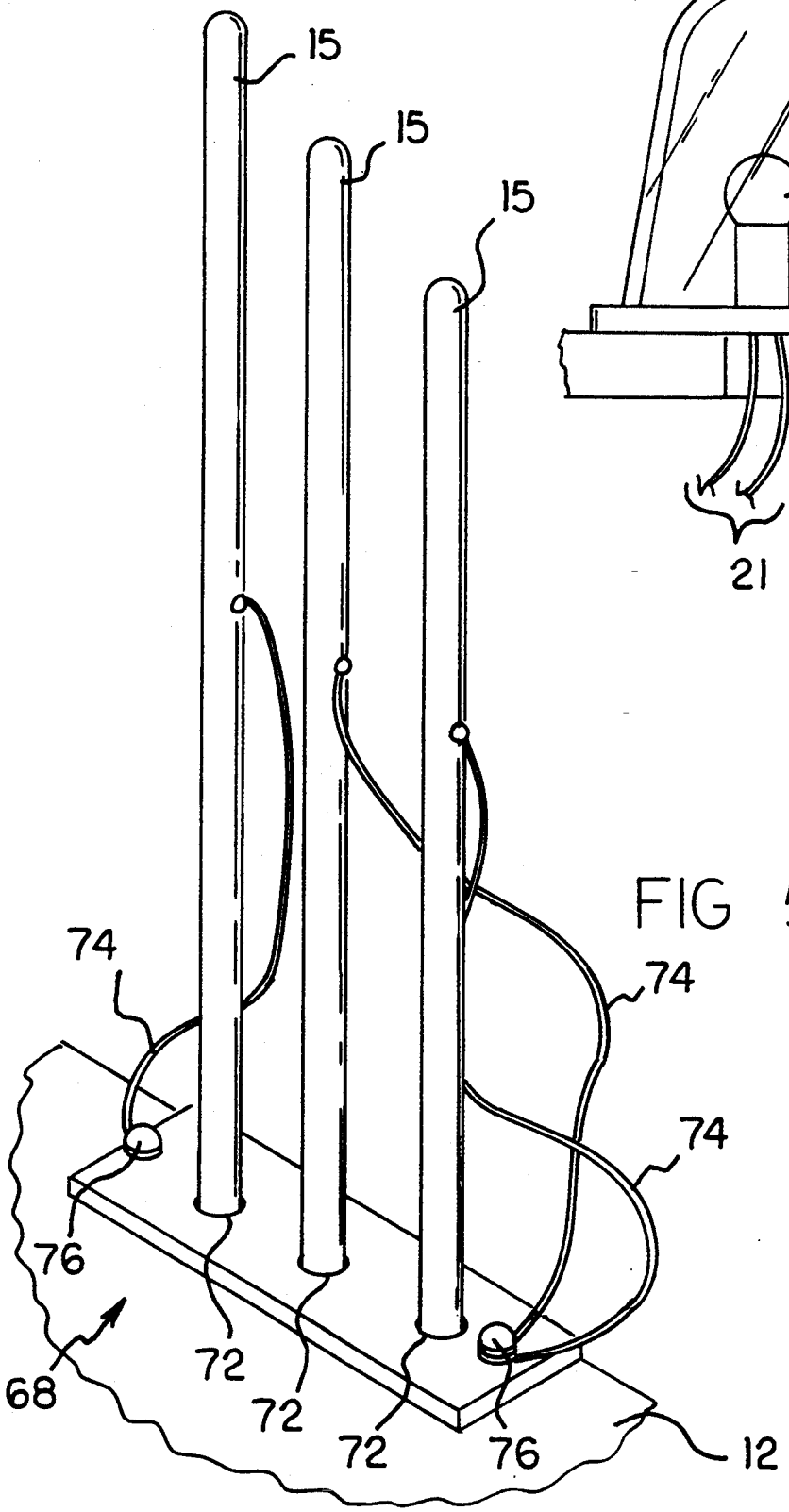
FIG. 5 is a partial perspective view of a second embodiment of the arm wrestling apparatus of the invention which includes a plurality of incremental counterforce resistance elements that are attached to a table with flexible tethers.

Turning to FIG. 5, a second embodiment of the invention is shown. Reference numerals are shown that correspond to like reference numerals that designate like elements shown in the other figures. In addition, a storage assembly 68 is supported by the table assembly 12 for storing a plurality of the incremental counterforce resistance elements 15. The storage assembly 68 includes a base plate 70 attached to the table assembly 12. The base plate 70 includes a plurality of wells 72 for receiving the incremental counterforce resistance elements 15. Respective tethers 74 are connected to respective incremental counterforce resistance elements 15, and tether-anchor assemblies 76 are connected to the base plate 70 for securing the tethers 74 to the base plate 70. The tethers 74 prevent the incremental counterforce resistance elements 15 from being separated or lost from the remainder of the arm wrestling apparatus 10 of the invention.

The components of the arm wrestling apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved arm wrestling apparatus that is low in cost, relatively simple in design and operation, and which may advantageously be used to provide a self-contained counterforce-exerting mechanism so that one person can develop arm wrestling strength by exercising against a counterforce-exerting mechanism. With the invention, a arm wrestling apparatus is provided which does not include hydraulic fluid. With the invention, a arm wrestling apparatus is provided which includes a resilient bumper located at the limit of simulated arm motion to prevent damage to the simulated arm and the object located at the limit of simulated arm motion. With the invention, a arm wrestling apparatus is provided which builds up counterforce resistance in an incremental way. With the invention, a arm wrestling apparatus is provided which provides with a device to assure that a person's elbow does not slide on a table top during simulated arm wrestling. With the invention, a arm wrestling apparatus is provided which is easily used by either right-handed or left-handed persons. With the invention, a arm wrestling apparatus is provided which provides that incremental increases of counterforce resistance can be installed easily and simply.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An arm wrestling apparatus, comprising:

a table assembly, a simulated arm assembly supported by said table assembly wherein said simulated arm assembly includes a plurality of receiver assemblies for receiving respective incremental counterforce resistance elements, an arm motion limit assembly supported by said table assembly for limiting motion of said simulated arm assembly, a limit signaling assembly supported by said table assembly for signaling when said simulated arm assembly reaches a limit of arm motion, said limit signaling assembly including a force-receiving portion adapted to receive force exerted by an incremental counterforce resistance element when said simulated arm assembly reaches said arm motion limit assembly, a plurality of incremental counterforce resistance elements adapted to be positioned one-at-a-time between said receiver assemblies on said simulated arm assembly and said force-receiving portion of said limit signaling assembly, said incremental counterforce resistance elements providing for a selection of increments in counterforce resistance to be overcome by a person who moves said simulated arm assembly to said arm motion limit assembly, and an indicator assembly, responsive to said limit signaling assembly, for indicating when said simulated arm assembly reaches a limit of arm motion.

2. The apparatus described in claim 1 wherein said table assembly includes four legs, an upper horizontal assembly supported by said legs, and a lower horizontal assembly supported by said upper horizontal assembly.

3. The apparatus described in claim 1 wherein said simulated arm assembly includes:

a simulated hand portion, a simulated arm portion supporting said simulated hand portion, and a simulated-arm-supporting assembly supporting said simulated arm portion and connecting said simulated arm portion to said table assembly.

4. The apparatus described in claim 3 wherein said simulated-arm-supporting assembly includes a plurality of retractable legs adapted to provide a boundary limit for knees of a person using said apparatus.

5. The apparatus described in claim 3 wherein said simulated-arm-supporting assembly includes:

a base member connected to said table assembly, and a plurality of spring assemblies connected to said base member and supporting said simulated arm portion.

6. The apparatus described in claim 5 wherein said spring assemblies include:

a rigid fastener connected to said base member, and a spring connected between said rigid fastener and said simulated arm portion of said simulated arm assembly.

7. The apparatus described in claim 6 wherein:

a longitudinal axis extends through said simulated arm assembly from said simulated hand portion through said simulated arm portion, one of said spring assemblies lies along said longitudinal axis between said simulated arm portion and said base member, and other of said spring assemblies are positioned peripheral to said longitudinal axis between said simulated arm portion and said base member.

8. The apparatus described in claim 1 wherein said receiver assemblies on said simulated arm portion are arrayed longitudinally beside and symmetrically astride said longitudinal axis.

9. The apparatus described in claim 1 wherein said arm motion limit assembly includes:

a rigid portion supported by said upper horizontal assembly of said table assembly, and a resilient bumper portion supported by said rigid portion.

10. The apparatus described in claim 1 wherein said incremental counterforce resistance elements include:

a plurality of rigid rods of different incremental predetermined length from each other.

11. The apparatus described in claim 1 where, further including:

a strap assembly connected to said table assembly for securing a user's elbow to said table assembly.

12. The apparatus described in claim 11 wherein said strap assembly includes:

a strap member attached to said table assembly, a slotted buckle attached to said strap member, and a catch attached to said table assembly for receiving said slotted buckle for securing a user's elbow to said table assembly.

13. The apparatus described in claim 1, further including:

a rod-force receiving assembly supported by said table assembly, said rod-force receiving assembly located between an end of an incremental counterforce resistance elements and said force-receiving portion of said limit signaling assembly.

14. The apparatus described in claim 13 wherein said rod-force receiving assembly includes:

a housing member supported by said upper horizontal assembly of said table assembly, a spring located within said housing member, a force-receiving plate connected to said spring for receiving force from an incremental counterforce resistance element, and a ram rod connected to said force-receiving plate for transmitting force received from said incremental counterforce resistance element to said force-receiving portion of said limit signaling assembly.

15. The apparatus described in claim 14 wherein limit signaling assembly includes:

a switch assembly adapted to be actuated by said ram rod of said rod-force receiving assembly in response to a selected one of said incremental counterforce resistance elements.

16. The apparatus described in claim 1 wherein said limit signaling assembly is connected to said indicator assembly with a conductor assembly.

17. The apparatus described in claim 1, further including:

a storage assembly supported by said table assembly for storing a plurality of said incremental counterforce resistance elements.

18. The apparatus described in claim 17 wherein said storage assembly includes:

a base plate attached to said table assembly, wherein said base plate includes a plurality of wells for receiving said incremental counterforce resistance elements.

19. The apparatus described in claim 18, further including:

respective tethers connected to respective incremental counterforce resistance elements, and tether-anchor assemblies connected to said base plate for securing said tethers to said base plate.

* * * * *